US011401744B2

(12) United States Patent
Farrugia

(10) Patent No.: US 11,401,744 B2
(45) Date of Patent: Aug. 2, 2022

(54) DAMPENED HINGE ASSEMBLY

(71) Applicant: Nikolaus Alexander Farrugia, Windsor Downs (AU)

(72) Inventor: Nikolaus Alexander Farrugia, Windsor Downs (AU)

( * ) Notice: Subject to any disclaimer, the term of this patent is extended or adjusted under 35 U.S.C. 154(b) by 72 days.

(21) Appl. No.: 16/968,844

(22) PCT Filed: May 2, 2019

(86) PCT No.: PCT/AU2019/050398

§ 371 (c)(1),
(2) Date: Aug. 10, 2020

(87) PCT Pub. No.: WO2019/210364

PCT Pub. Date: Nov. 7, 2019

(65) Prior Publication Data

US 2021/0017798 A1 Jan. 21, 2021

(30) Foreign Application Priority Data

May 3, 2018 (AU) ..... 2018901508

(51) Int. Cl.
*E05F 3/20* (2006.01)
*E05D 5/04* (2006.01)
(Continued)

(52) U.S. Cl.
CPC ..... *E05F 3/20* (2013.01); *E05D 5/04* (2013.01); *E05D 11/082* (2013.01);
(Continued)

(58) Field of Classification Search
CPC .. E05F 3/20; E05F 1/1025; E05D 5/04; E05D 11/082; E05Y 2201/408; E05Y 2201/412;
(Continued)

(56) References Cited

U.S. PATENT DOCUMENTS 5,572,768 A * 11/1996 Daul ..... E05F 1/1215 16/49
6,205,619 B1 * 3/2001 Jang ..... E05D 5/10 16/352

(Continued)

FOREIGN PATENT DOCUMENTS

DE 102006019548 A1 11/2007
EP 0251972 B1 11/1991

(Continued)

OTHER PUBLICATIONS

International Search Report dated Jul. 11, 2019 from PCT Application No. PCT/AU2019/050398.

(Continued)

*Primary Examiner* — Victor D Batson
*Assistant Examiner* — Matthew J Sullivan
(74) *Attorney, Agent, or Firm* — Innovation Capital Law Group, LLP; Vic Lin

(57) ABSTRACT

A dampened hinge assembly has a male leaf and a female leaf. The female leaf has spaced apart first and second end barrels coaxially rotating with respect to a central barrel of the male leaf therebetween. An axial shaft is fixed to the second end barrel of the female leaf at a proximal end of the axial shaft. The axial shaft has a distal helicoidally threaded spindle. A compression gear having a helicoidally threaded bore matching the helicoidal thread of the spindle displaces towards the first end barrel when the leaves move into alignment and towards the second end barrel when the leaves move out of alignment. The dampened hinge assembly may be reconfigured to provide soft closure, end-of-range soft closure and/or backcheck damping.

16 Claims, 5 Drawing Sheets

(51) Int. Cl.
*E05D 11/08* (2006.01)
*E05F 1/10* (2006.01)

(52) U.S. Cl.
CPC ..... *E05F 1/1025* (2013.01); *E05Y 2201/408* (2013.01); *E05Y 2201/412* (2013.01); *E05Y 2201/474* (2013.01); *E05Y 2201/484* (2013.01); *E05Y 2600/12* (2013.01); *E05Y 2800/20* (2013.01); *E05Y 2800/45* (2013.01); *E05Y 2900/132* (2013.01); *E05Y 2900/40* (2013.01)

(58) Field of Classification Search
CPC ..... E05Y 2201/474; E05Y 2201/484; E05Y 2600/12; E05Y 2800/20; E05Y 2800/45; E05Y 2900/132; E05Y 2900/40
See application file for complete search history.

(56) References Cited

U.S. PATENT DOCUMENTS

| | | | | |
|---|---|---|---|---|
| 8,015,665 | B2 * | 9/2011 | Pan | E05F 3/14 16/50 |
| 10,829,975 | B2 * | 11/2020 | Wu | E05F 3/20 |
| 2003/0177605 | A1 * | 9/2003 | Wang | E05F 1/1223 16/50 |
| 2009/0265889 | A1 * | 10/2009 | Pan | E05F 1/1008 16/308 |
| 2012/0227212 | A1 * | 9/2012 | Talpe | E05F 3/14 16/58 |
| 2013/0047512 | A1 * | 2/2013 | Bongiovanni | E05F 1/1223 49/137 |
| 2015/0204128 | A1 * | 7/2015 | Bacchetti | E05F 3/20 16/53 |
| 2015/0233164 | A1 * | 8/2015 | Bacchetti | E05F 1/1223 16/54 |
| 2018/0238092 | A1 * | 8/2018 | Feng | E05F 3/14 |
| 2019/0330903 | A1 * | 10/2019 | Talpe | E05D 3/02 |
| 2020/0141169 | A1 * | 5/2020 | Talpe | E05F 3/08 |
| 2020/0378168 | A1 * | 12/2020 | Chen | E05F 3/12 |
| 2021/0180381 | A1 * | 6/2021 | Wu | E05F 3/02 |
| 2021/0180385 | A1 * | 6/2021 | Wolf | E05F 15/41 |
| 2021/0381310 | A1 * | 12/2021 | Eichner | E05F 15/614 |

FOREIGN PATENT DOCUMENTS

| | | | |
|---|---|---|---|
| GB | 427551 | A | 4/1935 |
| GN | 2358178 | | 1/2000 |
| KR | 200361299 | Y1 | 9/2004 |
| KR | 20060021588 | A | 3/2006 |
| KR | 20140006326 | U | 12/2014 |
| WO | 2015056626 | A1 | 4/2015 |
| WO | 2017099511 | A1 | 6/2017 |

OTHER PUBLICATIONS

European Search Report dated Aug. 5, 2021 from related European Application No. 19796662.5.

* cited by examiner

DAMPENED HINGE ASSEMBLY

FIELD OF THE INVENTION

This invention relates generally to hinge assemblies and, more particularly, to dampened and torsion closure hinge assemblies.

BACKGROUND OF THE INVENTION

Known various types of hinges incorporate a braking mechanism to damp the closing of a gate or door. These hinges generally have a cylindrical body and one or two chambers of oil which is compressed to damp the closing of a door.

For example, EP 0251972 B1 (BEBEK VUKSIC) 27 Nov. 1991 [hereinafter referred to as D1] discloses a variant comprising a spring hinge with a damper, the braking effect of which is provided by the axial movement of a piston acting on a chamber of an oleohydraulic fluid, the capacity of which may be regulated to vary the closing speed of the door.

Further for example, CN 2358178 Y (DING MINGZHE) 12 Jan. 2000 [hereinafter referred to as D2] discloses a hinge having a upper sleeve barrel, a lower sleeve barrel forming a closed oil chamber, a sheathed barrel, wherein, the middle part of which is provided with the flange, rolling balls, a buffer shaft, wherein, the middle segment of which is provided with a screw thread groove, a spring, a buffer oil, and a one-way throttling piston. The one-way throttling piston is provided with a valve surface and the upper part of the valve surface is provided with axial one-way valve holes of throttling holes and steel balls; the spring and the buffer oil are arranged in the oil chamber; the one-way throttling piston is installed at the lower end of the buffer shaft in the sheathed barrel; the steel balls arranged in through holes on the periphery wall of the sheathed barrel are positioned in the screw thread groove of the buffer shaft.

However, these types of hinges have serious inconvenience of complex structure, which makes difficult their manufacture and repair. These types of hinges typically loose oily fluid resulting in a deterioration of the normal operation of the hinge and cannot be repaired on site given their complex structure. As such the hinge in its entirely must be removed either for replacement or for sending off to specialised repair, both of which are undesirous.

As such, a need exists for a dampened hinge which is less complex in design and which can be serviced in-situ without removal.

Furthermore, it would be desirous to be able to have a single type of hinge which can be reconfigured, including in-situ, to control the damping effects thereof. It would be further preferable to have a single type of hinge which can be configured to optionally control both closure and backcheck damping and, optionally, different types of closure damping.

For example, for particularly heavy doors, such as glass pool doors in excess of 70 kg, backcheck damping may be desirous. Furthermore, it may be desirous to control the type of soft closure damping including the range of soft closure.

Configuring the damping of D1 requires regulating the capacity of the oleohydraulic fluid which is difficult and not easy or impossible to perform on-site. Furthermore, the capacity of the oleohydraulic fluid may vary over time from fluid loss or chemical degradation and it is difficult or impossible to replace the fluid and recalibrate the capacity of the fluid using the arrangement of D1, especially without removing the hinge.

Similar problems abound for the configuration of D2. Furthermore, D2 is for rapid opening, and gentle closing and therefore cannot provide backcheck action, let alone reconfiguration thereof.

The present invention seeks to provide a hinge assembly, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a hinge assembly which is of simpler construction as compared to the complex integrally formed oleohydraulic fluid chamber arrangements of D1 and D2.

Furthermore, the present hinge assembly can be disassembled via end closures allowing for the reconfiguration and/or repair without removing the hinge from the gate and frame.

Furthermore, the configuration of the present hinge assembly allows for the on-site reconfiguration of soft closure and backcheck damping, including different types of soft closure damping across different ranges. As such, a single type of hinge may be easily reconfigured according to the particular type of door/gate installed, including without removal of the hinge.

Specifically, the present hinge assembly comprises a male leaf and a female leaf. The female leaf comprises a spaced apart first and second end barrels coaxially rotating with respect to a central cylindrical barrel of the male leaf therebetween.

An axial shaft is fixed to the second end barrel of the female leaf at a proximal end of the axial shaft. The axial shaft has a distal helicoidally threaded spindle.

The hinge assembly further comprises a compression gear having a helicoidally threaded bore matching the helicoidal thread of the spindle. The compression gear has external longitudinal threading matching interior longitudinal threading of the central barrel.

The helicoidal threading causes the compression gear to displace towards the first end barrel when the leaves move into alignment (i.e. during closure) and towards the second end barrel when the leaves move out of alignment (i.e., during opening).

The second end barrel engages a removable end closure having an axial bore such that the removable end closure can be removed in use for the installation of an optional elongate end-of-range soft closure compression strut within the bore for acting between a central distal bearing face of the compression gear and the removable end closure to across an end-of-range soft closure relative rotation offset range between the leaves.

Furthermore, the compression gear defines a peripheral distal bearing face and the removable end closure defines an oppositely facing peripheral bearing face such that the removable end closure can also be removed in use for the installation of an optional soft closure helicoidal compression spring coaxially with respect to the axial bore to act between the peripheral distal bearing face and the oppositely facing peripheral bearing face across a soft closure relative rotation offset range between the leaves, the soft closure offset range being greater than the end-of-range soft closure offset range.

As such, the present hinge can be reconfigured in situ to provide all, none, or a subset of soft closure and end-of-range soft closure damping. The configuration of the present arrangement allows for the simultaneous coaxial installation of both the compression strut and a helicoidal compression spring to provide both soft closure and end-of-range soft closure action simultaneously if desirous.

Furthermore, the present hinge can be serviced in situ to replace worn compression struts and helicoidal compression springs if needs be.

The second end barrel may further engage a second removable end closure which can be removed in use for the installation of an optional backcheck helicoidal compression spring coaxially with respect to the shaft and acting between a proximal peripheral bearing face of the compression gear and an oppositely facing bearing face of the second end closure.

As such, the present hinge assembly may be reconfigured in situ to provide optional backcheck action and serviced in situ to replace worn backcheck helicoidal compression springs.

Furthermore, the present male and female leaf may be reconfigured for use as a torsion hinge by the reconfiguration of the internal componentry as is illustrated in FIG. 7. As such, the same type of male and female leaves may be used to provide both dampened and torsion enclosure hinges.

None of the prior art, including D1 or D2 above disclose or obviously suggest the present configuration which is devoid of integral oleohydraulic fluid compression chambers.

Furthermore, none of the prior art or obviously suggest the present configuration which allows for the in-situ reconfiguration of soft closure, end-of-range soft closure and/or backcheck action.

According to one aspect, there is provided a dampened hinge assembly comprising a male leaf and a female leaf, the female leaf comprising spaced apart first and second end barrels coaxially rotating with respect to a central barrel of the male leaf therebetween, an axial shaft fixed to the second end barrel of the female leaf at a proximal end of the axial shaft, the axial shaft having a distal helicoidally threaded spindle, a compression gear having a helicoidally threaded bore matching the helicoidal thread of the spindle, the compression gear having external longitudinal threading matching interior longitudinal threading of the central barrel wherein the helicoidal threading between the leaves causes the compression gear to displace towards the first end barrel when the leaves move into alignment and towards the second end barrel when the leaves move out of alignment and wherein the first end barrel engages a removable end closure having an axial bore such that: the removable end closure can be removed in use for the installation of an optional elongate end-of-range soft closure compression strut within the bore in use for bearing against a central distal bearing face of the compression gear to act between the removable end closure and the compression gear across an end-of-range soft closure relative rotation offset range between the leaves; and wherein the compression gear defines a peripheral distal bearing face and the removable end closure defines an oppositely facing peripheral bearing face such that the removable end closure can be removed in use for the installation of an optional soft closure helicoidal compression spring coaxially with respect to the axial bore to act between the peripheral distal bearing face and the oppositely facing peripheral bearing face across a soft closure relative rotation offset range between the leaves, the soft closure offset range between the leaves being greater than the end-of-range soft closure offset range between the leaves.

The second end barrel may engage a second removable closure such that the second removable enclosure can be removed in use for the installation of an optional backcheck helical compression spring around the shaft to act between a peripheral proximal bearing face of the compression gear and the second removable closure across a backcheck relative rotation offset range between the leaves.

The end of range soft closure relative rotation offset range between the leaves may be less than 30° between the leaves.

The soft closure compression strut may not contact the central distal bearing face of the compression gear when the leaves are outside the end-of-range soft closure relative rotation offset range.

The removal end closure may comprise a removable end cap and a collar, the collar defining the axial bore.

The second removable enclosure may comprise a shaft stay comprising longitudinal threading slidably retained within matching interior longitudinal threading of the second end barrel.

The shaft stay may comprise a bore comprising longitudinal threading within which a proximal end of the shaft, comprising matching longitudinal threading, may be retained.

The dampened hinge may further comprise the compression strut.

The dampened hinge may further comprise the soft closure helicoidal compression spring.

The dampened hinge may further comprise both the compression strut and the soft closure helicoidal compression spring, the helicoidal compression spring coaxially retained with respect to the compression strut.

The dampened hinge may further comprise the backcheck helicoidal compression spring.

The backcheck helicoidal compression spring may be coaxially retained about the shaft.

The dampened hinge may further comprise all of the compression strut, the soft closure helicoidal compression spring and the backcheck helicoidal compression spring.

According to another aspect, a method of reconfiguring closure damping of the hinge may comprise removing the removable end closure from the first end barrel and inserting at least one of the soft closure compression strut and the soft closure helicoidal compression spring via the first end barrel, and replacing the removable end closure.

The method may comprise removing the second removable end closure from the second end barrel and inserting the backcheck helicoidal compression spring via the second end barrel, and replacing the second removable end closure.

The method may comprise removing the removable end closure from the first end barrel and replacing at least one of the soft closure compression strut and the soft closure helicoidal compression spring via the first end barrel, and replacing the removable end closure.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
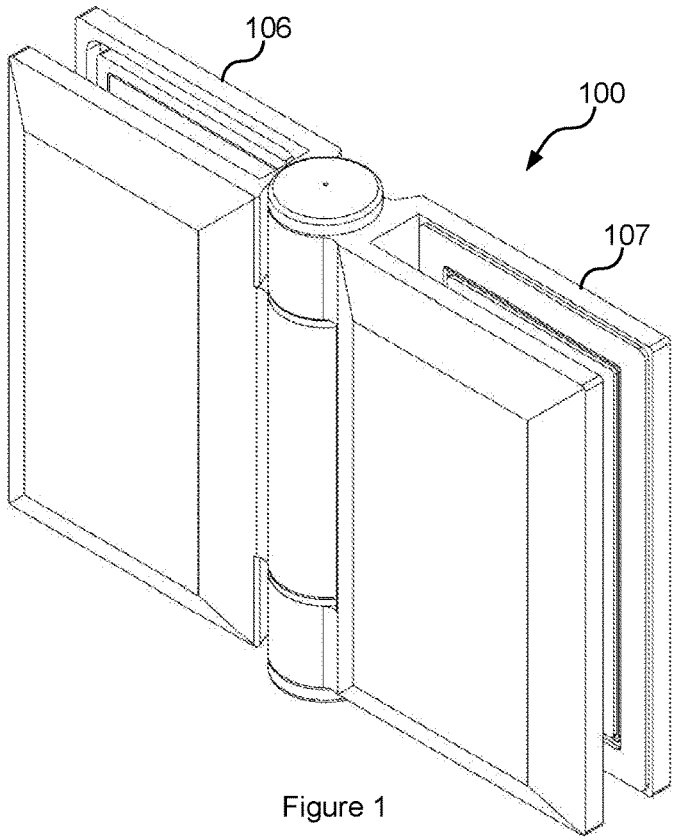
FIG. 1 shows a perspective view of an improved hinge assembly in accordance with an embodiment.
Figure 2:
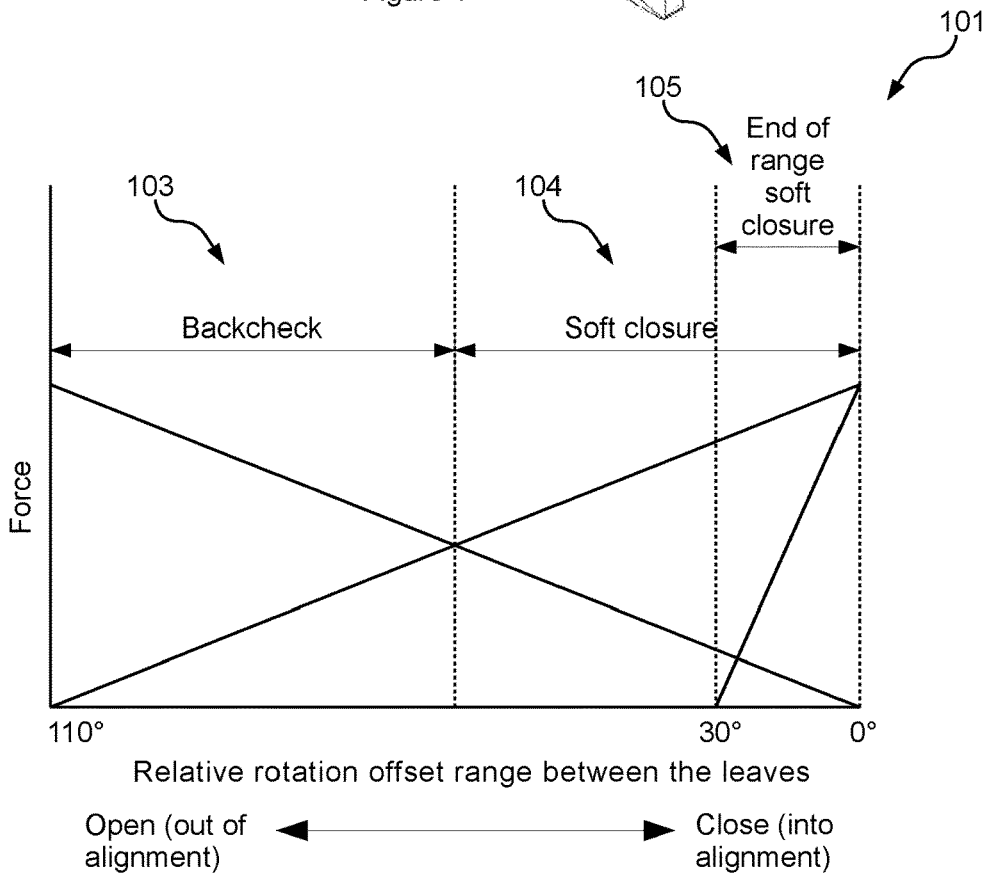
FIG. 2 illustrates backcheck, soft closure and end-of-range soft closure ranges.
Figure 3:
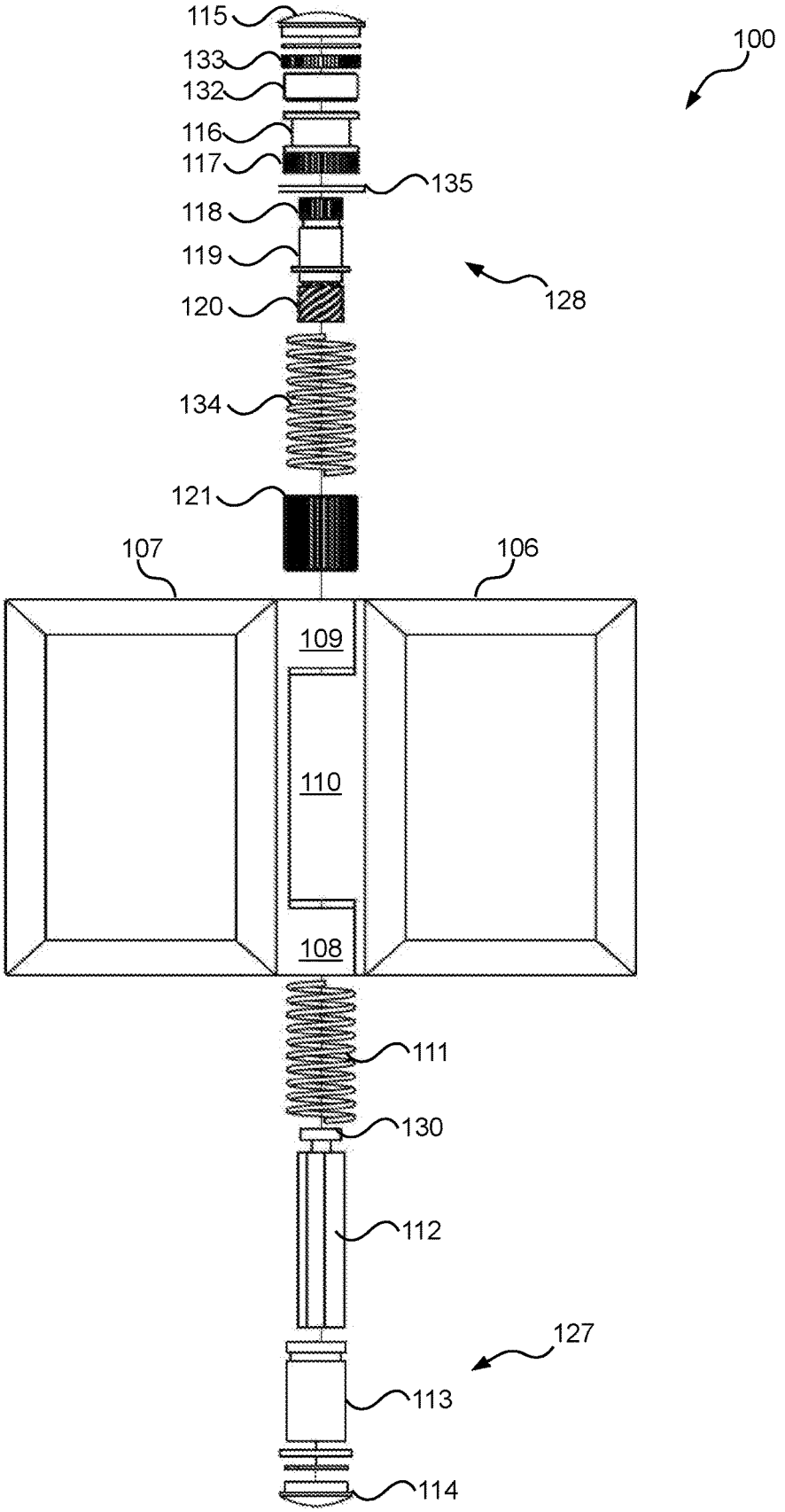
FIG. 3 shows a disassembled view of the hinge in accordance with an embodiment.

A dampened hinge assembly 100 comprises a male leaf 106 and a female leaf 107. The female leaf 107 comprises a spaced apart first end barrel 108 and a second end barrel 109. The first and second end barrels 108, 109 of the female leaf 107 coaxially rotate with respect to a central barrel 110 of the male leaf 106.

Figure 7:
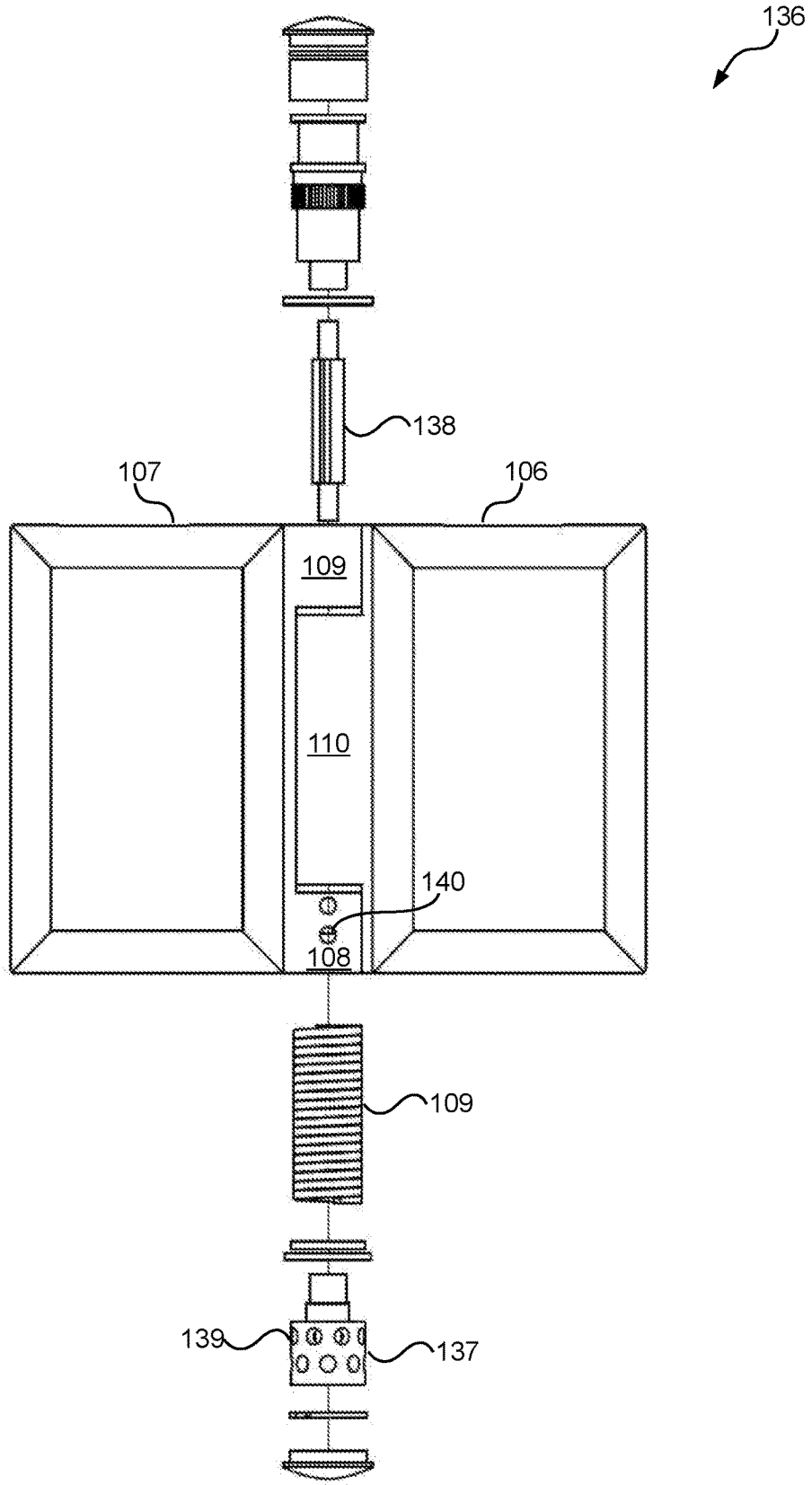
FIG. 7 illustrates a torsion hinge in accordance with an embodiment.

The hinge assembly 100 is typically used in conjunction with the torsion hinge 136 shown in FIG. 7 which may employ the same types of leaves 106, 107. The torsion hinge 136 provides closure torsion whereas the dampened hinge assembly 100 provides optional soft closure, end-of-range soft closure and or backcheck damping.

The torsion hinge 136 comprises a torsion barrel 137 which comprises a plurality of radial ports 139 through which a pin interlocks through an external aperture 140 to fix the torsion barrel 136 once wound. A torsion spring 109 acts on the torsion barrel 137 for torsion closure.

With respect to the dampened hinge 100, an axial shaft 119 is fixed to the second end barrel 109 of the female leaf 107 at a proximal end of the axial shaft 119.

The axial shaft 119 has a distally helicoidally threaded spindle 120.

A shaft stay 116 may interface the second end barrel 109 and the shaft 119. The shaft stay 116 may comprise exterior longitudinal threading which is slidably and non-rotatably engaged by matching longitudinal threading of an interior of the second end barrel 109.

The shaft stay 116 may comprise an interior bore comprising longitudinal threading within which a proximal end of the shaft 119, comprising matching longitudinal threading, is inserted.

The assembly 100 further comprises a compression gear 121 slidably retained within the central barrel 110 of the male leaf 106.

The compression gear 121 comprises external longitudinal threading matching interior longitudinal threading 122 of the central barrel 110.

The compression gear 121 further comprises a helicoidally threaded bore matching the helicoidal thread of the spindle 120.

The helicoidal threading of the spindle 120 and the central bore of the compression gear 121 is arranged such that when the leaves 106, 107 move into alignment, the compression gear 121 moves within the central barrel 110 towards the first end barrel 108 and, when the leaves 106, 107 move out of alignment, the compression gear 121 moves towards the second end barrel 109.

The first end barrel 108 engages a removable end closure 127. In embodiments, the removable end closure 127 may comprise a removable end cap 114 and collar 113. The removable end cap 114 may comprise threading so as to be able to be unscrewed from the first end barrel 108.

The removal end 127 has an axial bore 129. As such, in use, the removable end closure 127 can be removed for the installation of an optional elongate compression strut 112.

The elongate compression strut 112 may comprise a body and a plunger 130. The elongate compression strut 112 may be a gas or liquid compressed compression strut 112.

The compression strut 112 acts as a shock absorber between a central distal bearing face 131 of the compression gear 122 and the removable enclosure 127 across an end-of-range soft closure relative rotational offset range 105 between the leaves 106, 107, typically within the last 30° of closure. When outside this range, the compression strut 112 does not contact the central distal bearing face 131 of the compression gear 122.

The compression gear 122 defines a peripheral distal bearing face 125 and the removable enclosure defines an oppositely facing peripheral bearing face 126.

As such, the removable enclosure 127 can be removed in use for the installation of an optional helicoidal compression spring 111 coaxially with respect to the axial bore 129. The helicoidal compression spring 111 acts between the peripheral distal bearing face 125 of the compression gear 121 and the oppositely facing peripheral bearing face 126 of the removable enclosure 127 across a soft closure relative offset range 104 between the leaves 106, 107.

Figure 5:
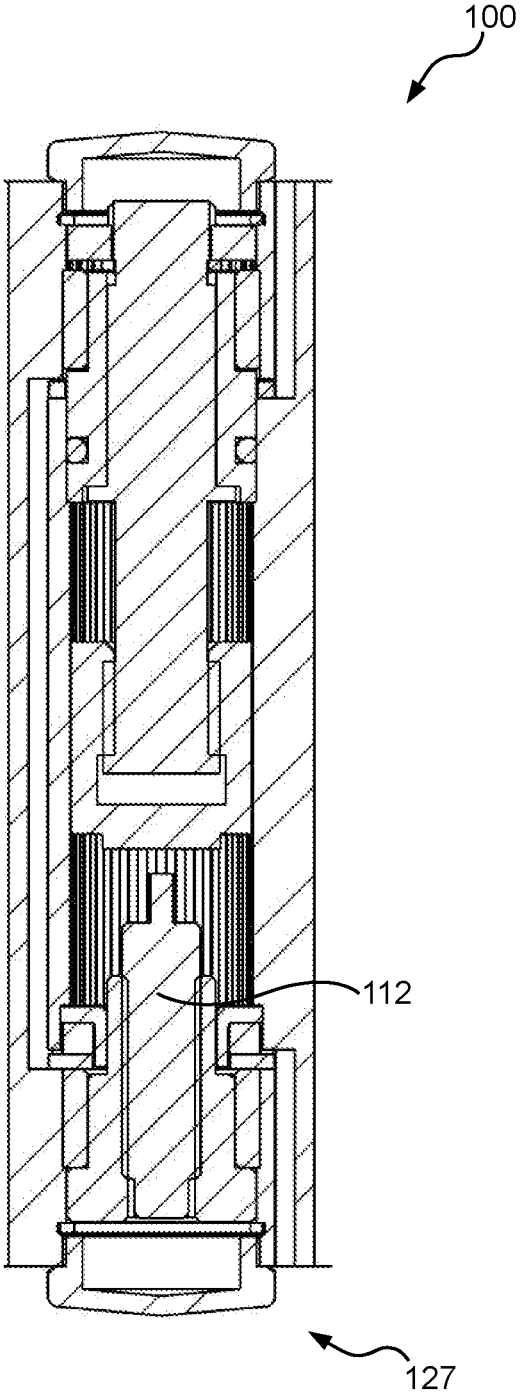
FIG. 5 illustrates the hinge configured for end-of-range soft closure action only.
Figure 6:
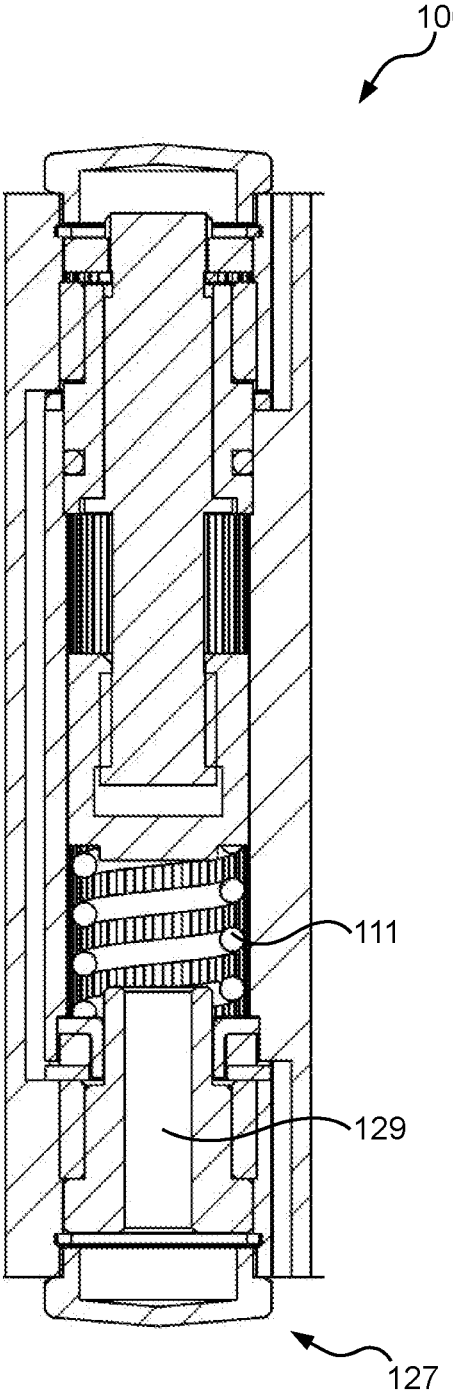
FIG. 6 illustrates the hinge configured for soft closure action only.

FIG. 5 illustrates the installation of the compression strut 112 to only provide only the end-of-range soft closure action 105. FIG. 6 illustrates the installation of the helicoidal compression spring 111 only to provide only the soft closure action 104.

Figure 4:
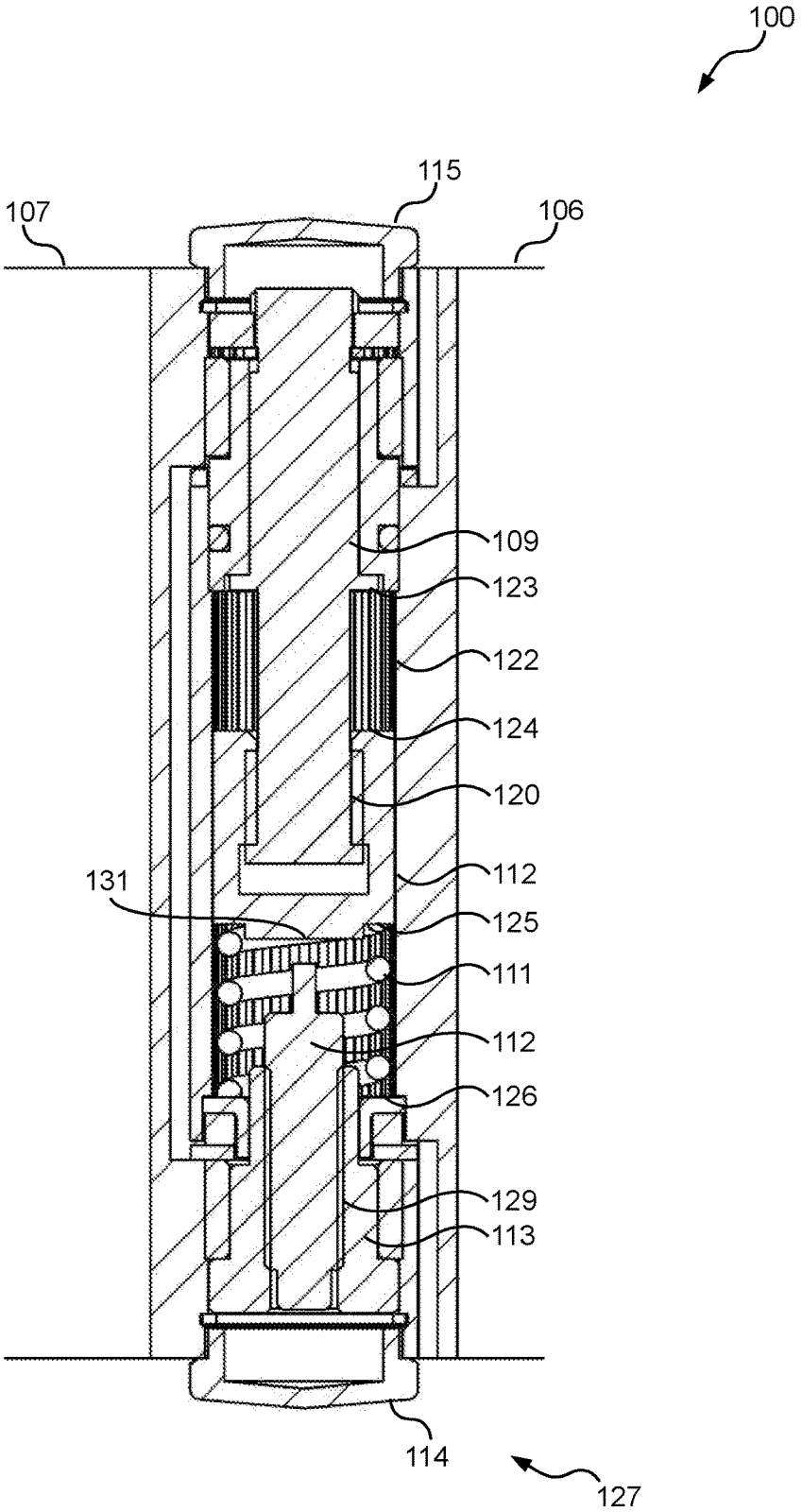
FIG. 4 shows an assembled view of the hinge in accordance with an embodiment.

FIG. 4 illustrates the coaxial installation of both of the compression strut 112 and the helicoidal idle compression spring 112 to provide both soft closure 104 and end-of-range soft closure 105.

The assembly 100 may further comprise a second removable closure 128 engaged by the second end barrel 109. The second removable closure 128 may comprise an enclosure cap 115 which can be removed to slide out the shaft stay 116. In embodiments, the second removable enclosure 128 may further comprise a female shaft stay 133 and Teflon™ bushing 132.

As such, the second removable enclosure 128 can be removed in use for the installation of an optional backcheck helicoidal compression spring 134 to provide backcheck action 103.

The compression gear 121 may define a proximal peripheral bearing face 124 and the second end closure 128 may comprise an oppositely facing peripheral bearing face 123 (which may be defined by a formation in the shaft 119, by a washer 135 or the like) which cooperate to compress the backcheck helicoidal compression spring 134 therebetween.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A dampened hinge assembly comprising a male leaf and a female leaf, the female leaf comprising spaced apart first and second end barrels coaxially rotating with respect to a central barrel of the male leaf therebetween, an axial shaft fixed to the second end barrel of the female leaf at a proximal end of the axial shaft, the axial shaft having a distal helicoidally threaded spindle, a compression gear having a helicoidally threaded bore matching the helicoidal thread of the spindle, the compression gear having external longitudinal threading matching interior longitudinal threading of the central barrel wherein the helicoidal threading between the leaves causes the compression gear to displace towards the first end barrel when the leaves move into alignment and towards the second end barrel when the leaves move out of alignment and wherein the first end barrel engages a removable end closure having an axial bore such that: the removable end closure can be removed in use for the installation of an elongate end-of-range soft closure compression strut within the bore in use for bearing against a central distal bearing face of the compression gear to act between the removable end closure and the compression gear across an end-of-range soft closure relative rotation offset range between the leaves; and wherein the compression gear defines a peripheral distal bearing face and the removable end closure defines an oppositely facing peripheral bearing face such that the removable end closure can be removed in use for the installation of a soft closure helicoidal compression spring coaxially with respect to the axial bore to act between the peripheral distal bearing face and the oppositely facing peripheral bearing face across a soft closure relative rotation offset range between the leaves, the soft closure offset range between the leaves being greater than the end-of-range soft closure offset range between the leaves.

2. A dampened hinge assembly as claimed in claim 1, wherein the second end barrel engages a second removable closure such that the second removable enclosure can be removed in use for the installation of a backcheck helical compression spring around the shaft to act between a peripheral proximal bearing face of the compression gear and the second removable closure across a backcheck relative rotation offset range between the leaves.

3. A dampened hinge assembly as claimed in claim 1, wherein the end of range soft closure relative rotation offset range between the leaves is less than 30° between the leaves.

4. A dampened hinge assembly as claimed in claim 3, wherein the soft closure compression strut does not contact the central distal bearing face of the compression gear when the leaves are outside the end-of-range soft closure relative rotation offset range.

5. A dampened hinge assembly as claimed in claim 1, wherein the removal end closure comprises a removable end cap and a collar, the collar defining the axial bore.

6. A dampened hinge assembly as claimed in claim 2, wherein the second removable enclosure comprises a shaft stay comprising longitudinal threading slidably retained within matching interior longitudinal threading of the second end barrel.

7. A dampened hinge assembly as claimed in claim 6, wherein the shaft stay comprises a bore comprising longitudinal threading within which a proximal end of the shaft, comprising matching longitudinal threading, is retained.

8. A dampened hinge assembly as claimed in claim 1, further comprising the compression strut.

9. A dampened hinge assembly as claimed in claim 1, further comprising the soft closure helicoidal compression spring.

10. A dampened hinge assembly as claimed in claim 1, further comprising both the compression strut and the soft closure helicoidal compression spring, the soft closure helicoidal compression spring coaxially retained with respect to the compression strut.

11. A dampened hinge assembly as claimed in claim 2, further comprising the backcheck helicoidal compression spring.

12. A dampened hinge assembly as claimed in claim 11, wherein the backcheck helicoidal compression spring is coaxially retained about the shaft.

13. A dampened hinge assembly as claimed in claim 2, further comprising all of the compression strut, the soft closure helicoidal compression spring and the backcheck helicoidal compression spring.

14. A method of reconfiguring closure damping of a hinge as claimed in claim 1, the method comprising removing the removable end closure from the first end barrel and inserting at least one of the soft closure compression strut and the soft closure helicoidal compression spring via the first end barrel, and replacing the removable end closure.

15. A method of reconfiguring backcheck damping of a hinge as claimed in claim 2, the method comprising removing the second removable end closure from the second end barrel and inserting the backcheck helicoidal compression spring via the second end barrel and replacing the second removable end closure.

16. A method of in-situ servicing a hinge as claimed in claim 1, the method comprising removing the removable end closure from the first end barrel and replacing at least one of the soft closure compression strut and the soft closure helicoidal compression spring via the first end barrel, and replacing the removable end closure.

* * * * *